US005284087A

United States Patent [19]

Vaarala

[11] Patent Number: 5,284,087

[45] Date of Patent: Feb. 8, 1994

[54] METHOD AND MEANS FOR MARKING A WORKPIECE

[76] Inventor: Harri Vaarala, Opettajankuja 6 A 9, SF-62200 Kauhava, Finland

[21] Appl. No.: 858,969

[22] PCT Filed: Nov. 23, 1990

[86] PCT No.: PCT/FI90/00285

§ 371 Date: May 19, 1992

§ 102(e) Date: May 19, 1992

[87] PCT Pub. No.: WO91/08062

PCT Pub. Date: Jun. 13, 1991

[30] Foreign Application Priority Data

Nov. 27, 1989 [FI] Finland ..... 895655

[51] Int. Cl.[5] ..... B31F 1/07

[52] U.S. Cl. ..... 101/32; 101/4; 101/28; 101/35

[58] Field of Search ..... 101/3.1, 4, 15, 16, 101/28, 29, 35, 18, 32; 285/93, 252, 256; 40/306, 316; 72/414

[56] References Cited

U.S. PATENT DOCUMENTS

| | | | |
|---|---|---|---|
| 984,009 | 2/1911 | Katzinger | 101/4 |
| 1,814,170 | 7/1931 | Long | 101/35 |
| 2,813,269 | 11/1957 | Jacobs | 101/35 |
| 3,140,655 | 7/1964 | Lally | 101/4 |
| 4,086,851 | 5/1978 | Brandell | 101/28 |
| 4,126,936 | 11/1978 | Koller | 29/628 |
| 4,159,677 | 7/1979 | Smith | 101/23 |
| 4,574,693 | 3/1986 | Fink et al. | 101/28 |

FOREIGN PATENT DOCUMENTS

| | | |
|---|---|---|
| 0266545 | 9/1987 | European Pat. Off. . |
| 2656615 | 7/1979 | Fed. Rep. of Germany . |
| 2815819 | 10/1979 | Fed. Rep. of Germany . |
| 486999 | 4/1970 | Switzerland . |

*Primary Examiner*—Edgar S. Burr
*Assistant Examiner*—Ren Yan
*Attorney, Agent, or Firm*—Ladas & Parry

[57] ABSTRACT

A method and marking device for imprinting indicia on the surface of an article, in which a holding strip is adhesively secured onto the surface of the article by an adhesive coating on the strip, the strip supporting, on its opposite surface, marking elements which are separate and distinct from the strip. The marking elements have a thickness substantially greater than the thickness of the strip and project from the strip so that under application of external pressure to the marking elements, the marking elements will be pressed into the surface of the article to leave an imprint of the marking elements therein. The strip with its marking elements is adhesively affixed to the article in the course of a production step in the manufacture and treatment of the article thereby avoiding the need for separate application of pressure to the marking elements.

17 Claims, 2 Drawing Sheets

METHOD AND MEANS FOR MARKING A WORKPIECE

FIELD OF THE INVENTION

The invention relates to a method for making a mark in an object. The invention also relates to an object marking means comprising one or several die means adapted for penetrating into the object and forming a mark therein.

BACKGROUND

Different marking systems are previously known, the purpose of which are to provide a marking sign upon the object to be marked. As one such system printing may be mentioned, the drawback of which often is i.a. the poor permanence of the mark on hard surface objects. Further relief letter arrangements and the use of press letters are known, the marking in question usually being temporary to its nature, and the generally poor surface adhesion of the marking constitutes no essential disadvantage. E.g. U.S. Pat. No. 4,159,677 discloses an arrangement, wherein a pattern is pressed into an essentially soft material using embossing bodies fastened on the surface of a cylinder and coated with a separate chromium surface coating.

An object made of metal or the like material having a hard surface can, in a known manner, be marked using cutting or vibrating engraving means or arc machining, in connection with which material is removed from the marked spot. The above mentioned methods make a somewhat permanent mark into the surface of the object, but the complexity especially when the character string i long constitutes a disadvantage. A marking in connection with serial production further requires rather difficult control arrangements.

In marking formable materials it is further known, that the markings may be driven or pressed into the base material using die means shaped as a sign or a sign string. Thus the result will be an imprint in the object surface, the imprint having as such a good permanence and having the shape of the sign or the sign string. The disadvantage of this method has until now been the complex apparatus or alternatively the use of means demanding a great amount of labour as well as the difficulty of producing of special high precision die means. As an example of such means the solutions shown in DE-patent 26 56 615 and EP-application 266 545 may be mentioned.

Especially in connection with hose assemblies or the like there is a demand for making marks into the connector collar, wherein the manufacturer and the manufacturing date are indicated as reference marks using such essentially permanent markings that a recognition later is possible. Such hose assemblies are often manufactured in such a way, that a ductile collar-shaped sleeve means is compressed under high surface pressure around the end of the hose, so that the sleeve means which is deformed under said pressure presses into the hose and locks it against a tubular inner piece. In order to solve i.a. questions of guarantee it has proven necessary, that the collar comprises the above mentioned reference markings, which as such may be scarcely in view, but the permanence of which must be preserved even after rough handling. Further it is sometimes necessary to mark the type, nominal pressure and the like data into the assembly in such a way, that the data is clearly noticeable. For example product liability legislation today imposes very high demands with respect to permanent marking, and for example bar codes which are specific for an object constitute an important part of modern automatic material handling.

Except for individual markings the making of said marks is in practice performed by making a mark in each work piece utilizing a separate marking device or by using letter type dies or the like which are fixed in a press tool or with corresponding loose dies mounted in the tool. When the mark is made using a separate marking device the marking procedure further will require an accessory device and a further phase of work. On the other hand manufacturing loose or fixed letters types arranged in press tools, and especially the replacement of such letter types, is difficult. Fixed letter types or a groove for loose letter types is formed using arc machining, machine cutting or the like method. A separate locking screw is used for locking the loose letter types. Letter types further should be provided in all the different types of tools.

In order to solve these problems the arrangement according to the present invention has been developed, the characteristic features of which appear from the enclosed claims, which are thus incorporated as a part of this specification. In the method according to the invention a separate thin marking device assembly is interposed between the tool and the object to be marked, one or several figure portions of said assembly forming an essentially permanent imprint in the surface of the object. According to the characteristic features of the invention thin die means formed as figures and arranged on a separate, substantially thin holding device are placed between the surfaces of a tool and the object, whereafter the tool in a manner known per se is made to move against the object in such a way, that said die means will be at least partly made to penetrate into the object.

SUMMARY OF THE INVENTION

A marking device according to the invention comprises a thin marking means assembly, which may be placed between the surfaces of a tool an the object to be marked. According to the characteristics of the invention said marking means is a separate means comprising at least one essentially thin holding device. Each die means is a thin body corresponding to the figure to be formed, whereby one or several die means, which is held by said holding device and extends parallel to the surface of said object and/or said tool, may be located between said object and said tool, which is to be moved towards said object in such a way that the movement of said tool presses said die means into the surface of said object to be marked. Said marking means assembly thus comprises thin figure portions, which under forceful pressing make a substantially permanent mark into the surface of said object. One or several die means, carried by said holding device, may be arranged between the object and a tool moving towards said object, whereby the position of each die means in the holding means may be predetermined in order to form an arbitrary die assembly.

BRIEF DESCRIPTION OF THE FIGURES OF THE DRAWING

The invention will now be described in more detail with reference to the attached drawings, wherein.

DETAILED DESCRIPTION OF PREFERRED EMBODIMENTS

Figure 1:
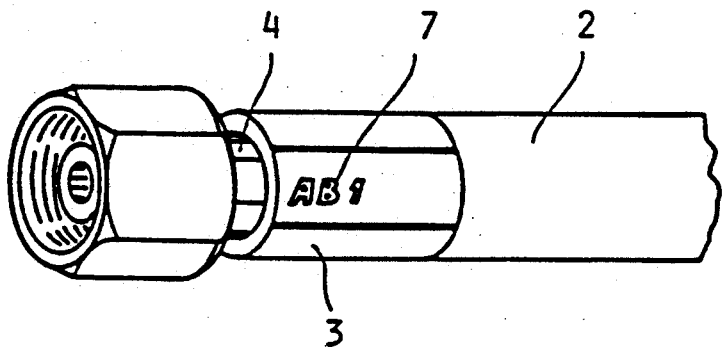
FIG. 1 shows a part of a hose assembly, into which a mark is pressed in accordance with the invention, FIG. 2 schematically shows the tool used to press said hose assembly, wherein pressing work jaws radially move towards the workpiece.
Figure 2:
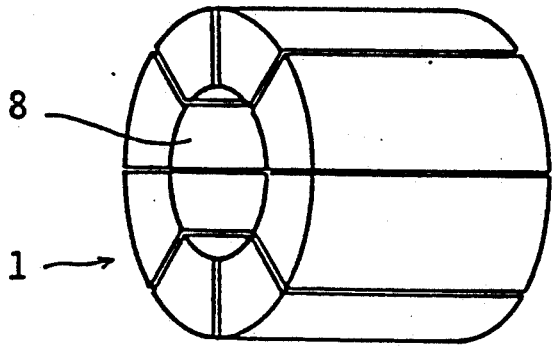

FIG. 1 shows one end of a hose assembly including the inner part 4 of a connector, a hose 2 and a collar bushing 3 made of metal or the like and pressing the hose 2 against said inner part 4 of the connector. Such a connector is in a known manner fixed to the hose 2 by compressing said collar bushing 3 around said hose using a crimping tool 1 shown in FIG. 2. The pressure is normally of the order of 10 . . . 400 metric tons, depending on the diameter and the pressure resistance needed. When the pressing jaws have a diameter of about 15 mm and a length of about 55 mm the surface pressure will be at least of the order 5 MPa, preferably 10 . . . 100 MPa, sometimes as high as 1000 MPa.

According to the invention a mark 7, for example the logotype of the manufacturer, the type and serial number of the connector, a bar code and/or the manufacturing date, is made by arranging a remarkably thin marking means assembly between the pressing jaws 8 of the aforesaid pressing tool 1 and the collar sleeve 3 prior to the pressing of the actual manufacturing operation. Thus the marking will be performed, according to the inventive method, during the pressing process related essentially to the actual manufacturing without the use of any separate apparatus or specially designed pressing tools. In the simplest embodiment of the invention said marking means assembly comprises only one single mark or figure, whereby several assemblies may be separately put in place. In practice the arranging of such individual very thin marks into a specific position often causes problems especially in industrial production, and therefore the assembly according to the invention has been developed, said assembly comprising one or several marks or figures fastened to a separate thin holding device 5.

Figure 3:
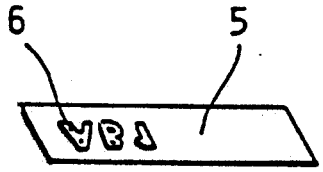
FIG. 3 shows a marking means assembly according to one embodiment of the invention and having its holding device and die means attached thereto.

According to FIG. 3 the marking means assembly thus comprises a thin holding device 5, which holds the separate figure portions in predetermined positions. According to the invention each figure portion comprises a thin die means 6, which, in connection with the pressing of said bushing 3, sinks into the material of said bushing 3 in such a way, that a recessed denotation or imprint 7 in the shape of said figure will be formed into the material.

The marking means assembly according to the invention comprises a thin holding device 5, whereby each die means 6 is a thin piece substantially in the shape of the mark to be made. Held by the holding device 5 one or several die means 6 may be placed between an object and a tool movable towards said object. On the other hand the position of each die means 6 in the holding device 5 can be especially easily predetermined in order to form an arbitrary die assembly.

Figure 6:
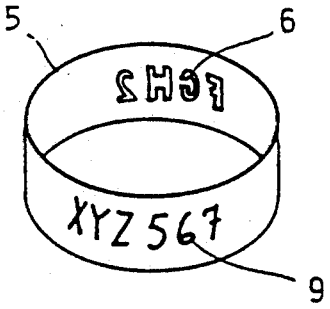
FIG. 6 shows a special holding device intended in particular for the marking of round or polygonal objects.

According to one advantageous embodiment of the invention the thin holding device 5 is a strip-like means in the form of a support or substrate as shown in FIG. 3, said strip-like means having means 6 penetrating into the object. In another embodiment according to FIG. 6 said holding device is a ring- or bushing like device which is to be placed around said object 3. According to another advantageous embodiment said holding device with its figure portions is placed, prior to the pressing or a corresponding operation, into a position which separately indicates the pressing date in such a way, that a denotation indicating the date will be positioned against a clearly distinguishable portion. Thus, for example a mark made in the forward end corresponds to the first part of the year.

As is evident from the above specification and the figures, die means suitably formed according to the desired mark are preferably used in the strip-like holding device as figure portions, which die means are placed against that surface of said holding device 5 which is directed towards said object 3, and the die means 6 are made at least partially to penetrate into the object. According to one advantageous embodiment of the invention said die means arrangement thus may be placed as such and substantially separately between the tool and the object.

In another advantageous embodiment of the invention said strip like holding device further has at least one adhesion surface, preferably a glued surface especially for receiving said die means 6. In this embodiment said holding device 5 favorably is a tape or the like, whereby the glued surface conveniently both holds said die means 6 in their places on said holding means 5 and keeps the whole assembly in its place against the object 3 prior to and during the marking.

Figure 5:
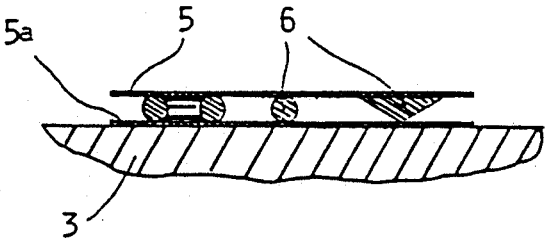
FIG. 5 shows a corresponding section of a die means according to another embodiment of the invention placed against the surface of an object, where as parallel alternatives are indicated on one hand substantially round and on the other hand substantially triangular means.

In the embodiment according to FIG. 5 the holding device 5 comprises two tape strips 5, 5*a*, which are located on both sides of the die means 6, whereby said die means 6 will keep their position especially well. The tape 5*a* located against the object 3 is favorably a two-sided tape, so that it has a glued surface on the surface turned against said die means 6 as well as on the surface turned against the object 3.

In another embodiment die means 6 are attached, prior to the pressing or the like operation, directly onto the surface of the tool 1 or the object 3, using a weak glue or the like fastening means, so that they will remain well in place even during the initial stage of the pressing. In this embodiment the tape constituting the holding device 5 is used as a positioning means and preferably also as a fastening means.

According to one embodiment of the invention the holding device surface facing towards the tool 1 is a glued surface or the like adhesive surface, whereby said holding device 5 with its die means 6 will stay essentially permanently fastened to the tool 1, such as to the pressing surface of a press or even a marking hammer. Alternatively a marking means assembly according to the invention constitutes a separate additional piece, which, when needed, is placed on the object 3 to be marked, whereafter a separate pressing or impact is performed in order to press the die means 6 located on said holding means 5 of said marking means assembly into the surface of the object to be marked. In one special embodiment said holding device 5 may itself be loosened from the die means 6, whereby said die means, which preferably differ with respect to color or material, then remain in the pressed object 3 inlaid into its surface.

Figure 4:
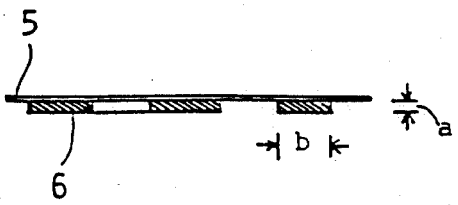
FIG. 4 shows a section, in exaggerated dimensions, of the holding device according to FIG. 3.

FIGS. 4 and 5 show die means arrangements according to some advantageous embodiments of the invention. In the solution according to FIG. 4 the die means are formed of a thin hard sheet figure made preferably of metal. For the forming of the actual marks methods such as optical typesetting, laser cutting, arc machining, metal spraying, etching, electrolytic manufacturing or any like method may be used, by which said thin die means in the desired shape may be manufactured.

A certain internal stability in connection with the die means 6 is an essential feature for the invention. The height of the sheet like die means, in other words the sheet thickness a, by which is indicated the extension of the die means 6 from the surface of the holding device 5, should be so small, in relation to the linear width b of the die means 6, that no considerable internal deformation may take place in the die means 6 in connection with the pressing, assuming that the material hardness is suitable for the manufacturing of the die means, and that the die means will not tilt over in connection with the pressing operation. In known marking dies a base portion and its extension are used for this purpose, which portion increases greatly from the sharp edge of the die, whereby the deformation and tilting is prevented. According to the invention quite as good a result is achieved even with a mere uniformly thick sheet like die piece, provided that the die means is thin enough. Alternatively, however, a die means according to the invention may also be formed in section as a low triangle or, in another embodiment, essentially round, whereby no tilting, but a certain deformation may occur. For this reason a round die means is recommended mainly in disposable cases. FIG. 5 shows a die assembly according to these embodiments, and it simultaneously shows a second coexistent holding device 5*a*. In the case of a die means with a round section the section is preferably circular or preferably somewhat oval. The die means itself may in this embodiment be thread like, whereby the thread diameter preferably may be 0.1 to 0.5 mm without any considerable deformation being discernible even in rather soft materials like ordinary steel.

For sheet like die means a preferred relation between sheet thickness and line width should not be more than about 0.5, preferably not more than 0.20. For the marking efficiency it is advantageous, that the die means is a figured means, the thickness of which is 0.05 to 1.00 mm, preferably 0.10 to 0.20 mm. An especially preferred manufacturing method contemplates that the die means 6 or a series of die means corresponding to the figure or figure sequence is manufactured directly onto the holding device 5 by etching in a way which is known per se e.g. from the circuit board technique. As an alternative manufacturing method a method may be mentioned, wherein said thin die means are manufactured separately, whereafter they are transferred and/or fastened onto the holding means, favorably onto a plastic strip. The height of a die means 6 made e.g. from chromium steel will typically be about 0.15 mm, which gives a clearly readable marking in the pressed object. If the thickness of the strip used as said holding means 5 is of the order 0.01 to 1.0 mm, will the total thickness of such a marking means assembly will favorably be about 0.06 to about 2.0 mm. Thicknesses above this may be utilized especially in a heavy metal industry, rolling mills and the like, where a rather deep extending marking is to be made in a semi-finished product, which mark as such should be identifiable even in a raw product, or which should still be identifiable after a surface finishing by analyzing the structure of the material more closely. In the case of the hose connection mentioned above it has been observed, that a strip thickness of about 0.03 mm and a die means thickness of 0.1 to 0.15 mm provide an especially good result, whereby the marking means assembly still remains usable even after a great number of uses.

In this connection it may be noted, that even a quite low impression of the die means 6 causes deformations in the object 3, which deformations may be read with suitable means when the human eye no longer can easily distinguish the made mark. Thus an advantageous use of the invention is for bar codes relating especially to automatic goods management, said bar codes being easy to form according to the invention into an object simultaneously with the pressing of the object for example in connection with its manufacture. In this case the holding device may comprise a tape, or, according to one embodiment of the invention, a thin hard metal strip, onto which a mirror image of the bar code is formed e.g. by etching.

In some cases it may be sufficient, that one or several portions forming the mark are removed from the holding device itself, whereby said holding device 5 itself, with its remaining "negative" portions function as a die means 6 according to the invention. In this case an imprint of the holding device itself will remain in the object 3, when the removed portions of the holding device 5 protrude in the form of mark 7 from the impression corresponding to the holding device.

Figure 7:
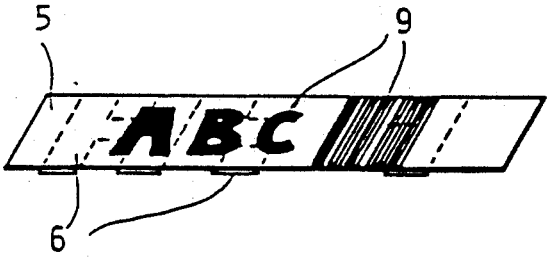
FIG. 7 shows an advantageous embodiment, wherein the holding device as such is intended to remain, after the pressing, on the surface of the object.

According to an advantageous embodiment of the invention the strip-like holding device 5 comprises an ordinary tape, to which the die means 6 making the markings is attached. Practical experiments have surprisingly revealed an additional especially advantageous feature of the invention, that is the fact, that the holding device 5 itself, that is a tape provided with a glued surface, under very high pressure will itself become especially well attached onto the workpiece. It has appeared, that ordinary tape under the impact of the rather high pressing pressure coming into question may attach e.g. to said metal bushing 3 so firmly, that is is extremely difficult to remove. It has also appeared, that any figures printed onto said tape, e.g. a bar code, serial number and/or the contact data for the manufacturer, will stay essentially permanently on the object. In FIG. 7 there is disclosed a marking means assembly of this kind.

The exceptionally good fastening of the tape can i.a. be explained by the fact, that the tape glue at the very high pressures in question will be levelled into a very thin film, which at the same time hardens. In this embodiment said tape is utilized under circumstances, for which it has not earlier been used. Normally a tape will be positioned with finger pressure or, at the most, a slight roller pressure, whereby its is common knowledge, that e.g. a blow striking the tape will break the tape without any essential attachment taking place. If such a tape is, however, compressed under circumstances, where the pressing pressure is both high and even, no aforementioned breaking can take place, whereby the preconditions for attachment differ essentially from those prior known. This observation gives the grounds for another advantageous embodiment of the invention, where the holding device 5 itself, on the surface directed away from the object 3 comprises figure portions 9, which in connection with the pressing remain as such in view on the surface of the tape attached very firmly to the object. In the most simple cases the figure portions thus comprise e.g. colored tape strips.

An especially advantageous embodiment of the invention further comprises, that on said holding device 5, that is the tape, there are die means 6 penetrating into the object 3 as well as suitably other kinds of marking portions located on the surface of the holding device 5, which portions together with the tape remain essentially permanently on the surface of the workpiece 3. The latter marks may comprise marks showing the name of the product, its quality, its properties, bar coded data and/or a serial marking, which marks will be easily visible on the surface of the product. A tape attached in this way may, however, still be removed by hard scraping, whereby under the mark, despite the removal of the tape, the mark 7 of the die means 6 impressed into the surface still remain, indicating such data through which the object 3 can still be unambiguously identified.

One characteristic feature of the method according to the invention thus is, that a holding device 5 having raised marks 6 is placed between a workpiece 3 and a tool 1. In connection with a pressing belonging to some other working operation the raised marks 6 are impressed into the workpiece 3 and form a permanent marking. For example a coupling may thus be marked by fastening thereto or to the pressing tool a tape having raised marks, which during the manufacturing operation impress a permanent trace into the pressed coupling. The marking can be performed e.g. with the help of a loose tape in connection with another working operation, and no separate marking stage is needed.

The above specification discloses, by way of examples, applications of the invention mainly in connection with a hose assembly, but it is evident for the person skilled in the art, that the invention is not restricted to the shown embodiments or fields of use, but that within the scope of the claims the invention can be utilized in many other manufacturing and marking situations, e.g. in deep drawing presses or the like. The invention is further useful i.a. in metal rolling mills, in the mechanical engineering industry in connection with all kinds of presses, in cutting machines attached e.g. to sheet clamps, in the marking of cable shoes and wire ends, etc.

I claim:

1. A method of producing a mark in an object comprising providing a holding strip having marking means separate and distinct from said holding strip affixed thereto, adhesively securing said holding strip onto a surface of said object, said marking means having a thickness substantially greater than the thickness of the strip to project from said strip, applying external pressure on said object via the marking means and said strip to press the marking means into the object and leave an imprint of the marking means in said object, and releasing the external pressure and removing the marking means from the object to leave the imprint of the marking means in said object.

2. A method as claimed in claim 1, comprising removing the holding strip after the external pressure has been released.

3. A method as claimed in claim 1, comprising providing said holding strip with an adhesive surface by which the holding strip is secured to the object.

4. A method as claimed in claim 3, comprising providing said holding strip with a second adhesive surface opposite the first said adhesive surface and adhesively connecting the marking means on said second adhesive surface to affix said marking means to said strip.

5. A method as claimed in claim 4, comprising forming said adhesive strip as an annular strip.

6. A method as claimed in claim 3, wherein said applying of external pressure on said object produces deformation of said object in the course of a production step in the manufacture and treatment of said object.

7. A marking device for imprinting indicia on the surface of an article, said marking device comprising a substrate support having a surface with means for attachment to the surface of said article, and marking means secured on said substrate support, said marking means being separate and distinct from said substrate support, said marking means having a thickness substantially greater than the thickness of said substrate support to project from said substrate support and means for applying external pressure, to the marking device to press the marking means into the surface of the article to produce an imprint of the marking means on the surface of the article which remains after removal of the marking means from said article.

8. A marking device as claimed in claim 7, wherein said means on the substrate support for attachment to the surface of the article comprises an adhesive.

9. A marking device as claimed in claim 8, wherein said adhesive provides a detachable connection between the substrate support and said surface of the article.

10. A marking device as claimed in claim 8, comprising a second substrate support facing the first said substrate support with said marking means interposed between the two substrate supports.

11. A marking device as claimed in claim 7, comprising an adhesive layer on said substrate support on a surface thereof opposite the surface having the means for attachment to the surface of an article, said marking means being on said adhesive layer.

12. A marking device as claimed in claim 7, wherein said substrate support comprises a thin strip.

13. A marking device as claimed in claim 12, wherein said strip is annular.

14. A marking device as claimed in claim 7, wherein said marking means comprises relatively thin marking elements having a ratio of width to thickness of at most 0.50.

15. A marking device as claimed in claim 14, wherein the ratio of width to thickness of the marking elements is at most 0.20.

16. A marking device as claimed in claim 7, wherein said marking means comprises marking elements of round shape.

17. A marking device as claimed in claim 11, wherein said marking means comprises a plurality of separate marking elements on said adhesive layer.

* * * * *